US009802295B2

(12) United States Patent
Zhang

(10) Patent No.: US 9,802,295 B2
(45) Date of Patent: Oct. 31, 2017

(54) CLAMPING DEVICE

(71) Applicants: Fu Tai Hua Industry (Shenzhen) Co., Ltd., Shenzhen (CN); HON HAI PRECISION INDUSTRY CO., LTD., New Taipei (TW)

(72) Inventor: Bing-Jun Zhang, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 55 days.

(21) Appl. No.: 14/695,742

(22) Filed: Apr. 24, 2015

(65) Prior Publication Data

US 2016/0193719 A1 Jul. 7, 2016

(30) Foreign Application Priority Data

Jan. 5, 2015 (CN) ..... 2015 2 0003118 U

(51) Int. Cl.
*B25B 5/14* (2006.01)
*B25B 5/00* (2006.01)

(52) U.S. Cl.
CPC ..... *B25B 5/145* (2013.01); *B25B 5/003* (2013.01); *B25B 5/006* (2013.01)

(58) Field of Classification Search
CPC ..... B25B 5/14; B25B 5/145; B25B 5/163; B25B 5/02; B25B 5/06; B25B 1/18
See application file for complete search history.

(56) References Cited

U.S. PATENT DOCUMENTS 2,605,795 A * 8/1952 Tracy ..... B25B 5/06 269/133
2,881,645 A * 4/1959 Kruchten ..... B25B 1/10 269/181
3,386,726 A * 6/1968 Lorenz ..... B23B 5/12 269/218
3,653,708 A * 4/1972 Merola ..... B23Q 7/043 294/102.1
3,899,162 A * 8/1975 Fischer ..... B25B 1/18 269/25
4,821,393 A * 4/1989 Spigarelli ..... B23Q 3/183 269/224
5,139,246 A * 8/1992 Yakou ..... B25B 1/18 269/242
6,394,521 B1 * 5/2002 Bertini ..... B25J 15/026 294/119.1

(Continued)

*Primary Examiner* — Joseph J Hail
*Assistant Examiner* — Tyrone V Hall, Jr.
(74) *Attorney, Agent, or Firm* — Steven Reiss

(57) ABSTRACT

A clamping device includes two mounting members facing each other, a driver coupled to the two mounting members and at least one clamping module. Thee driver is configured to alternately drive the two mounting members toward and away from each other. The clamping module includes two clamping members mounted on the two mounting members. Each clamping member includes a guide rod, a clamping block, and an elastic member. One end of the guide rod movably passes through a corresponding mounting member. The clamping block is fixed at one end of the guide rod distal from the mounting member. The elastic member is sleeved on the guide rod and positioned between the mounting member and the clamping block.

18 Claims, 3 Drawing Sheets

(56) References Cited

U.S. PATENT DOCUMENTS

| | | | | |
|---|---|---|---|---|
| 7,820,942 | B1 * | 10/2010 | Lamsfuss | B23K 26/0084 219/121.68 |
| 8,702,081 | B2 * | 4/2014 | Melchior | B25B 5/10 269/107 |
| 8,840,155 | B2 * | 9/2014 | Morita | B23P 19/084 29/278 |
| 8,857,804 | B2 * | 10/2014 | Wang | G01N 3/04 269/111 |
| 8,905,452 | B2 * | 12/2014 | Williams | B25J 15/026 294/192 |
| 2011/0024962 | A1 * | 2/2011 | Zhang | B25B 5/06 269/107 |
| 2013/0068803 | A1 * | 3/2013 | Brodeur | A47G 25/88 223/113 |

* cited by examiner

CLAMPING DEVICE

FIELD

The present disclosure relates to a clamping device, and more particularly, to a clamping device for clamping a thin-walled workpiece.

BACKGROUND

Currently, electronic devices, such as televisions, displays, and tablet computers are often equipped with thin-wall frames. In clamping a thin-walled workpiece, the workpiece is easily deformed when the clamping force is not well controlled.

BRIEF DESCRIPTION OF THE DRAWINGS

Implementations of the present technology will now be described, by way of example only, with reference to the attached figures.

DETAILED DESCRIPTION

Figure 1:
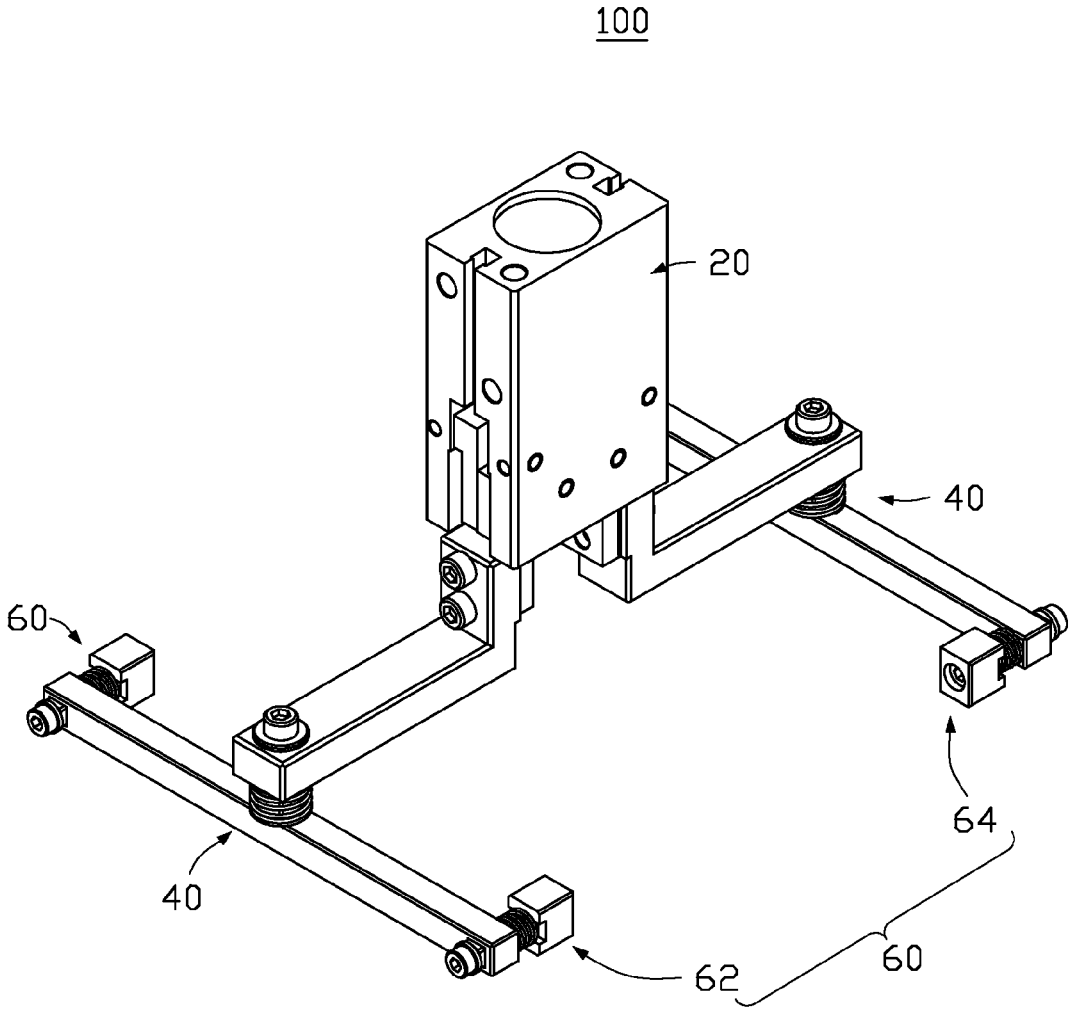
FIG. 1 is an isometric view of one embodiment of a clamping device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" when utilized, means "including, but not necessarily limited to"; it specifically indicates open-ended inclusion or membership in the so-described combination, group, series and the like.

The present disclosure is described in relation to a clamping device.

FIG. 1 illustrates that a clamping device 100 can include a driver 20, two mounting members 40, and two clamping modules 60. The driver 20 can be coupled to a lift mechanism (not shown), thus the clamping device 100 can move along a first direction. The driver 20 can be configured to alternately drive the two mounting members 40 toward and away from each other. In at least one embodiment, the first direction is the vertical direction. The two mounting members 40 can be coupled to the driver 20 and facing to each other. The two mounting members 40 can move toward or away from each other along a second direction when driven by the driver 20. The second direction can be perpendicular to the first direction. Each clamping module 60 can include clamping members 62 and 64 facing each other, and the clamping members 62 and 64 can be mounted at the corresponding mounting members 40, thus the clamping members 62 and 64 can move toward each other to clamp a workpiece (not shown), or move away from each other to release the workpiece. The two clamping modules 60 can be symmetrically mounted at two sides of the mounting members 40. In other embodiments, the clamping device 100 can include one clamping module 60.

Figure 2:
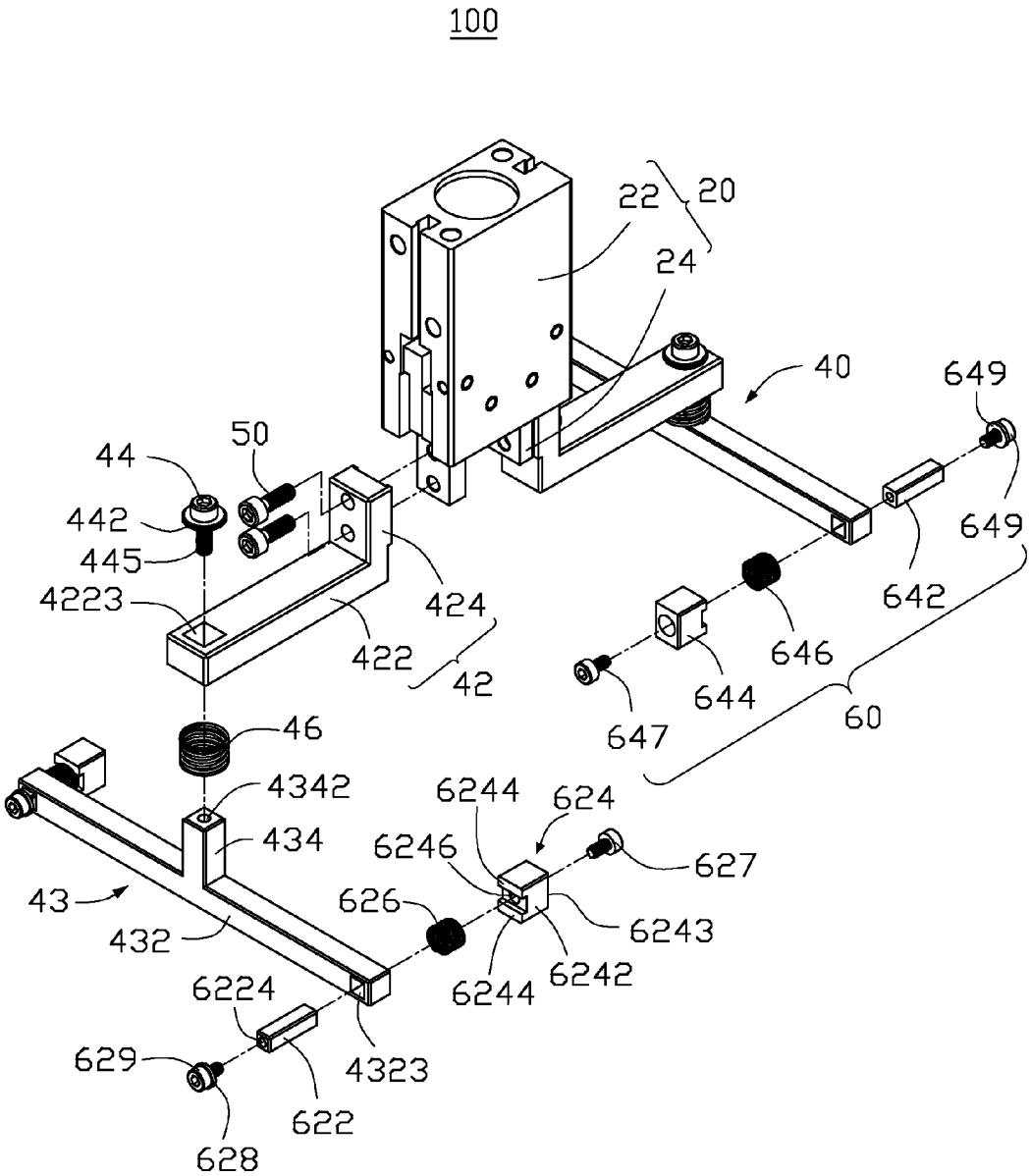
FIG. 2 is an exploded view of the clamping device shown in FIG. 1.

FIG. 2 illustrates that the driver 20 can include a driver main body 22 and two drive shafts 24 protruding out of the driver main body 22. The driver main body 22 can be coupled to the lift mechanism. The two drive shafts 24 can be positioned spaced from each other and can move toward or away from each other driven by the driver main body 22. In at least one embodiment, the driver 20 can be a cylinder.

Each mounting member 40 can include a supporting arm 42, a mounting arm 43, a stopper 44, and a buffer part 46. The supporting arm 42 can be fixed to one corresponding drive shaft 24, and the mounting arm 43 can be movably coupled to one end of the supporting arm 42 away from the driver 20. The stopper 44 can be coupled to the supporting arm 42 and the mounting arm 43 to prevent the mounting arm 43 from dropping off the supporting arm 42. The buffer part 46 can be positioned between the supporting arm 42 and the mounting arm 43. When the clamping device 100 moves along the first direction, the buffer part 46 can prevent the clamping device 100 from crashing into a stage disposing the workpiece.

The supporting arm 42 can be a L-shaped pole and include a main portion 422 and a connecting portion 424 extending vertically from one end of the main portion 422. One end of the main portion 422 away from the connecting portion 424 can define a mounting hole 4223 through thereof. The connecting portion 424 can be fixed to the corresponding drive shaft 24 by screws 50.

The mounting arm 43 can include a main body 432 and a protrusion portion 434. In at least one embodiment, the main body 432 can be substantially column shaped and define two installing holes 4323 at two ends thereof. The two installing holes 4323 can be used to mount the clamping members 62 and 64. The protrusion portion 434 can be protruded out of a middle portion of the main body 432 toward the supporting arm 42. One end surface of the protrusion portion 434 toward the supporting arm 42 can define a threaded hole 4342. The buffer part 46 can be sleeved on the protrusion portion 434, and two ends of the buffer part 46 can be positioned between the main body 432 and the main portion 422.

The stopper 44 can include a first stopper piece 442 and a first stopper screw 445. The first stopper piece 442 can cover the mounting hole 4223 and be positioned away from the mounting arm 43. The first stopper screw 445 can movably pass through the first stopper piece 442 and be threaded into the threaded hole 4342, thus the supporting arm 42 and the mounting arm 43 can be connected. The first stopper piece 442 can be larger than the mounting hole 4223 to prevent the mounting arm 43 from dropping off the supporting arm 42.

FIG. 1 and FIG. 2 illustrate that the clamping members 62 and 64 of each clamping module 60 can be mounted in the two installing holes 4323 of the two mounting arms 43, and arranged at a same side of the driver 20. The clamping member 62 can include a guide rod 622, a clamping block 624, and an elastic member 626. The guide rod 622 can pass through the installing hole 4323 of the corresponding mounting member 40, and can move along the installing hole 4323. The clamping block 624 can be mounted at one end of the guide rod 622 distal from the mounting member 40. In at least one embodiment, the clamping block 624 can include a resisting portion 6242 and two protruded ridges 6244 extending from a surface of resisting portion 6242 toward the guide rod 622. The resisting portion 6242 can have a resisting surface 6243 toward the other mounting arm 43, and the resisting surface 6243 can be configured to abut the workpiece for clamping the workpiece. The two protruded ridges 6244 can be substantially parallel to and distanced from each other, and cooperatively form a slot 6246 therebetween. On end of the guide rod 622 away from the mounting arm 43 can be clasped in the slot 6246, thus the guide rod 622 can be coupled to the clamping block 624. The elastic member 626 can be sleeved on the guide rod 622, and the elastic member 626 can be positioned between the main body 432 and the protruded ridges 6244.

The clamping member 62 can further include a screw nut 627. The guide rod 622 can define a locking hole 6224 through thereof along a second direction, and the screw nut 627 can pass through the clamping block 624 to engage with the locking hole 6224, thus the clamping block 624 and the guide rod 622 can be fixed together, and the clamping block 624 would not move relative to the guide rod 622 when clamping the workpiece. The clamping member 62 can further include a second stopper piece 628 and a second stopper screw 629. The second stopper piece 628 can be positioned away from the clamping block 624 and cover the installing hole 4323. The second stopper screw 629 can pass through the second stopper piece 628 and be threaded into the locking hole 6224. The second stopper piece 628 can be larger than the installing hole 4323 to prevent the guide rod 622 from dropping off the mounting arm 43. In at least one embodiment, the clamping block 624 can be made of a flexible material.

The clamping member 64 can be substantially the same with the clamping member 62. The clamping member 64 can include a guide rod 642, a clamping block 644, an elastic member 646, a screw nut 647, a second stopping piece 648, and a second stopper screw 649.

In assembly, the two supporting arms 42 can be fixed to the two drive shafts 24 of the driver 20. The buffer members 46 can be sleeved on the protrusion portions 434, and the protrusion portions 434 can penetrate the mounting holes 4223, then the stopper members 44 can pass through the mounting holes 4223 to be connected to the mounting arms 43. After that, the guide rod 622 of the clamping member 62 can movably pass through the installing hole 4323, and the elastic member 626 can be sleeved on the guide rod 522. Then the clamping block 624 can be fixed at one end of the guide rod 622 toward the other mounting arm 43. The clamping block 624 and the guide rod 622 can be fixed by the screw nut 627, and the second stopper piece 628 and second stopper screw 629 can be mounted at one end portion of the guide rod 622 away from the clamping block 624. The clamping member 64 can be coupled to the other arm 43 in the same way with the clamping member 62.

Figure 3:
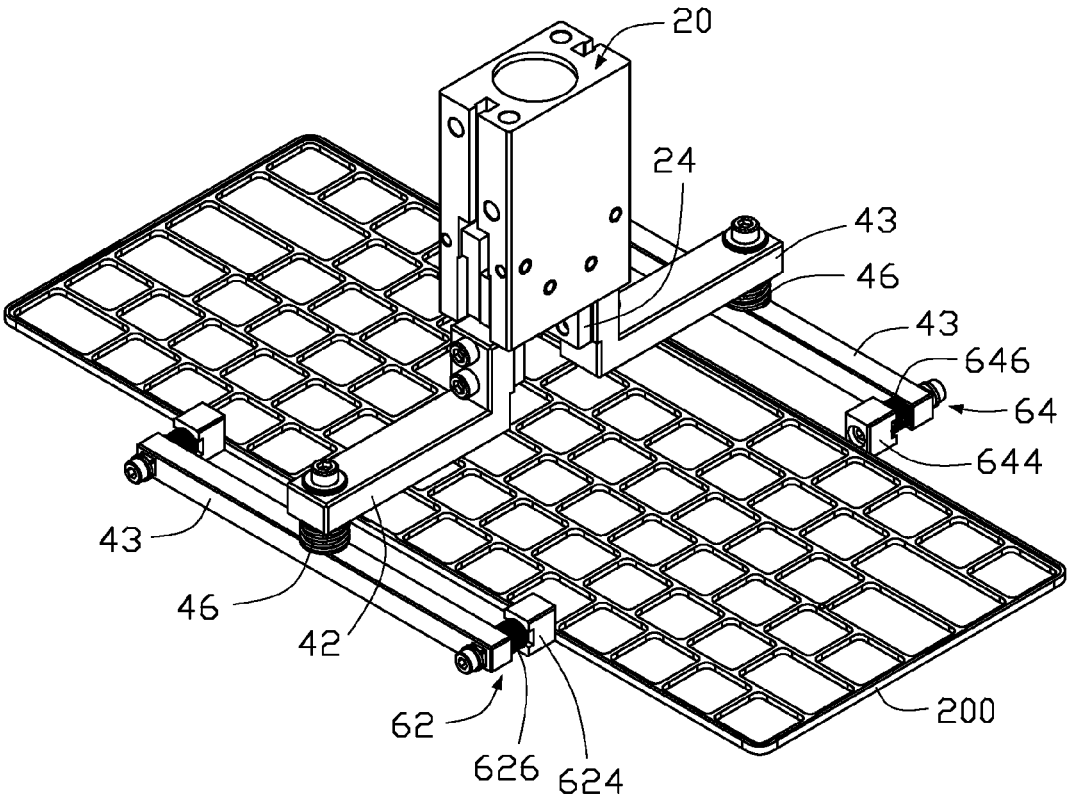
FIG. 3 is an isometric view of the clamping device in use.

FIG. 3 illustrates the clamping device 100 in use. In use, a workpiece 200 can be positioned at a stage (not shown), and the driver 20 can fixed to the lift mechanism. The drive shafts 24 can move away from each other driven by the driver 20. Then the clamping device 100 can move to the top of the workpiece 200, and then move toward the workpiece 200 driven by the lift mechanism until the clamping blocks 624 and 644 contact the stage. The mounting arms 43 can move toward the supporting arms 42 to compress the buffer parts 46, thus the clamping blocks 624 and 644 closely contact the stage without any space. Then, the driver shafts 24 can drive the two clamping blocks 624 and 644 move toward each other to clamp two sides of the workpiece 200. If the clamping force is too large, a space between the two clamping blocks 624 and 644 can be smaller than a width of the workpiece 200. The clamping blocks 624 and 644, and the guide rods 622 and 642 (shown in FIG. 2) can move away from the workpiece 200 along a second direction, and the elastic member 626 and 646 can undergo elastic deformation, thus the workpiece 200 would not be deformed under the too large clamping force. When releasing the workpiece 200, the two drive shafts 24 can move away from each other, and the workpiece 200 can be released. At the same time, the buffer parts 46, the elastic members 626 and 646 can reset.

If the clamping force is too large, the clamping blocks 624 and 644, and the guide rods 622 and 642 can move away from the workpiece 200 to compress the elastic member 626, thus the clamping device 100 can prevent distortion of the workpiece 200 causing by the large clamping force. The elastic members 626 and 646 having proper spring force can make the clamping force constant. Moreover, the buffer part 46 located between the supporting arm 42 and the mounting arm 43 can prevent the clamping device 100 from crashing into the stage. The clamping members 624 and 644 made of flexible material can prevent the workpiece 200 from scratching.

In other embodiments, the mounting arm 43 of the mounting member 40 can be integrally formed with the supporting arm 42. The buffer part 46 can be omitted, and the clamping members 62 and 64 can be arranged at the two opposite mounting members 40.

In other embodiments, the second stopper piece 628 and the second stopper screw 629 can be omitted, and one end of the guide rod 622 away from the clamping block 624 can include a resisting portion (not shown) larger than the installing hole 4323.

In other embodiments, the screw nut 627 can be omitted, and the guide rod 622 can be clasped in the slot 6246.

The embodiments shown and described above are only examples. Many details are often found in the art such as the other features of a clamping device. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including, the full extent established by the broad general meaning of the terms used in the claims. It will therefore be appreciated that the embodiments described above may be modified within the scope of the claims.

What is claimed is:

1. A clamping device comprising:

two mounting members facing each other;

a driver coupled to the two mounting members and configured to alternately drive the two mounting members toward and away from each other; and at least one clamping module comprising two clamping members mounted on the two mounting members, each of the two clamping members comprising:

a guide rod, one end of which movably passing through a corresponding mounting member;

a clamping block fixed at one end of the guide rod distal from the corresponding mounting member; and an elastic member sleeved on the guide rod and positioned between the corresponding mounting member and the clamping block;

wherein the driver comprises a driver main body and two drive shafts protruding out of the driver main body, the two drive shafts are driven by the driver body to move toward or away from each other, and each of the two mounting members is fixed to one corresponding drive shaft;

wherein the clamping block comprises a resisting portion and two protruding ridges extending from a surface of the resisting portion toward the guide rod, one end of the guide rod away from the corresponding mounting member is clasped between the two protruding ridges to connect the guide rod and the clamping block, and two ends of the elastic member resist against the corresponding mounting member and the two protruding ridges.

2. The clamping device of claim 1, wherein:

each mounting member comprises a supporting arm and a mounting arm, one end of the supporting arm is coupled to the driver, and a part of the mounting arm movably penetrate another end of the supporting arm away from the driver; and wherein the guide rods of the two clamping members are mounted at the corresponding mounting arms, and the elastic member is positioned between the mounting arm and the clamping block.

3. The clamping device of claim 2, wherein:

one end of the supporting arm comprises a mounting hole, the mounting arm comprises a main body and a protrusion portion protruding from the main body toward the supporting arm, and the protrusion portion movably passes through the mounting hole; and wherein the elastic member is positioned between the main body and the clamping block.

4. The clamping device of claim 3, wherein:

each mounting member further comprises a stopper coupled to the supporting arm and the protrusion portion, and the stopper comprises a first stopper piece and a first stopper screw; and wherein the first stopper piece is positioned away from the mounting arm and covers the mounting hole, and the first stopper screw passes through the first stopper piece to couple to the protrusion portion.

5. The clamping device of claim 3, wherein each mounting member further comprises a buffer part sleeved on the protrusion portion and positioned between the supporting arm and the main body.

6. The clamping device of claim 2, wherein the mounting arm defines an installing hole, and the guide rod passes through the installing hole and is movable along the installing hole.

7. The clamping device of claim 6, wherein each clamping member further comprises a second stopper piece and a second stopper screw, the second stopper piece is positioned away from the clamping block and covers the installing hole, and the second stopper screw passes through the second stopper piece to couple to the guide rod.

8. The clamping device of claim 2, wherein one end of the supporting arm comprises a connecting portion fixed at one corresponding driver shaft, and the mounting arm is movably coupled to another end of the supporting arm away from the mounting portion.

9. The clamping device of claim 1, wherein the clamping device comprises two clamping modules, each mounting member has two opposite sides, and the two clamping modules are mounted at each of the two opposite sides of the corresponding mounting member.

10. A clamping device comprising:

two mounting members facing each other;

a driver coupled to the two mounting members and configured to alternately drive the two mounting members toward and away from each other; and at least one clamping module comprising two clamping members mounted on the two mounting members, each of the two clamping members comprising:

a guide rod, one end of which movably passes through a corresponding mounting member;

a clamping block fixed at one end of the guide rod distal from the corresponding mounting member; and an elastic member sleeved on the guide rod and positioned between the corresponding mounting member and the clamping block;

wherein the clamping block comprises a resisting portion and two protruding ridges extending from a surface of the resisting portion toward the guide rod, one end of the guide rod away from the corresponding mounting member is clasped between the two protruding ridges to connect the guide rod and the clamping block, and two ends of the elastic member resist against the corresponding mounting member and the two protruding ridges.

11. The clamping device of claim 10, wherein:

each mounting member comprises a supporting arm and a mounting arm, the supporting arm having at least one end, the at least one end of the supporting arm is coupled to the driver, and a part of the mounting arm movably penetrates another end of the supporting arm away from the driver; and wherein the guide rods of the two clamping members are mounted at the corresponding mounting arms, and the elastic member is positioned between the mounting arm and the clamping block.

12. The clamping device of claim 11, wherein:

one end of the supporting arm defines a mounting hole there through, the mounting arm comprises a main body and a protrusion portion protruding from the main body toward the supporting arm, and the protrusion portion movably passes through the mounting hole; and wherein the elastic member is positioned between the main body and clamping block.

13. The clamping device of claim 12, wherein:

each mounting member further comprises a stopper coupled to the supporting arm and the protrusion portion, and the stopper comprises a first stopper piece and a first stopper screw; and wherein the first stopper piece is positioned away from the mounting arm and covers the mounting hole, and the first stopper screw passes through the first stopper piece and to couple to the protrusion portion.

14. The clamping device of claim 12, wherein each mounting member further comprises a buffer sleeved on the protrusion portion and positioned between the supporting arm and the main body.

15. The clamping device of claim 11, wherein the mounting arm defines an installing hole, and the guide rod passes through the installing hole and is movable along the installing hole.

16. The clamping device of claim 15, wherein each clamping member further comprises a second stopper piece and a second stopper screw, the second stopper piece is positioned away from the clamping block and covers the installing hole, and the second stopper screw passes through the second stopper piece and to couple to the guide rod.

17. The clamping device of claim 11, wherein the driver comprises a driver main body and two drive shafts protruding out of the driver main body, one end of the supporting arm comprises a connecting portion fixed at one corresponding driver shaft, and the mounting arm is movably coupled to another end of the supporting arm away from the mounting portion.

18. The clamping device of claim 10, wherein the clamping device comprises two clamping modules, each mounting member has two opposite sides, and the two clamping modules are mounted at each of the two opposite sides of the corresponding mounting member.

* * * * *